US006352638B2

(12) United States Patent
Jacobson et al.

(10) Patent No.: US 6,352,638 B2
(45) **Date of Patent: *Mar. 5, 2002**

(54) TWO-STAGE PROCESS FOR CONVERTING RESIDUA TO GASOLINE BLENDSTOCKS AND LIGHT OLEFINS

(75) Inventors: Mitchell Jacobson, West Orange, NJ (US); Willibald Serrand, Buxheim (DE)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/735,777

(22) Filed: Dec. 13, 2000

Related U.S. Application Data

(63) Continuation of application No. 09/418,061, filed on Oct. 14, 1999, now abandoned.

(51) Int. Cl.[7] ..... C10G 51/04

(52) U.S. Cl. ..... 208/73; 208/72; 208/126; 208/67; 208/75; 208/77; 208/146; 208/153; 208/163; 585/648

(58) Field of Search ..... 208/126, 67, 72, 208/73, 75, 77, 146, 153, 163; 585/648

(56) References Cited

U.S. PATENT DOCUMENTS

| | | | | |
|---|---|---|---|---|
| 5,167,795 A | * | 12/1992 | Gartside | 208/67 |
| 5,348,642 A | * | 9/1994 | Serrand et al. | 208/113 |
| 5,714,663 A | * | 2/1998 | Serrand et al. | 585/648 |
| 5,879,535 A | * | 3/1999 | Serrand et al. | 208/126 |
| 5,879,536 A | * | 3/1999 | Serrand et al. | 208/126 |
| 5,952,539 A | * | 9/1999 | Seimandi et al. | 585/648 |

FOREIGN PATENT DOCUMENTS

| | | | |
|---|---|---|---|
| EP | 0291408 A1 | 11/1988 | C10G/9/32 |
| WO | WO97/04043 | 2/1997 | C10G/55/06 |
| WO | WO97/31083 | 8/1997 | C10G/9/32 |
| WO | WO99/03951 | 1/1999 | C10G/51/04 |

* cited by examiner

*Primary Examiner*—Nadine Preisch
(74) *Attorney, Agent, or Firm*—Gerard J. Hughes

(57) ABSTRACT

A two-stage process for converting petroleum residua and other low value oils to high valued gasoline blendstocks and light olefins. The first stage is comprised of a thermal process unit containing a reaction zone comprised of a horizontal moving bed of fluidized hot particles operated at temperatures from about 500 to 600° C. and having a short vapor residence time, and the second stage is comprised of a catalytic conversion zone operated at a temperature of about 525° C. to about 650° C., and also having a short vapor residence time, preferably shorter than that of the first stage reaction zone.

10 Claims, 1 Drawing Sheet

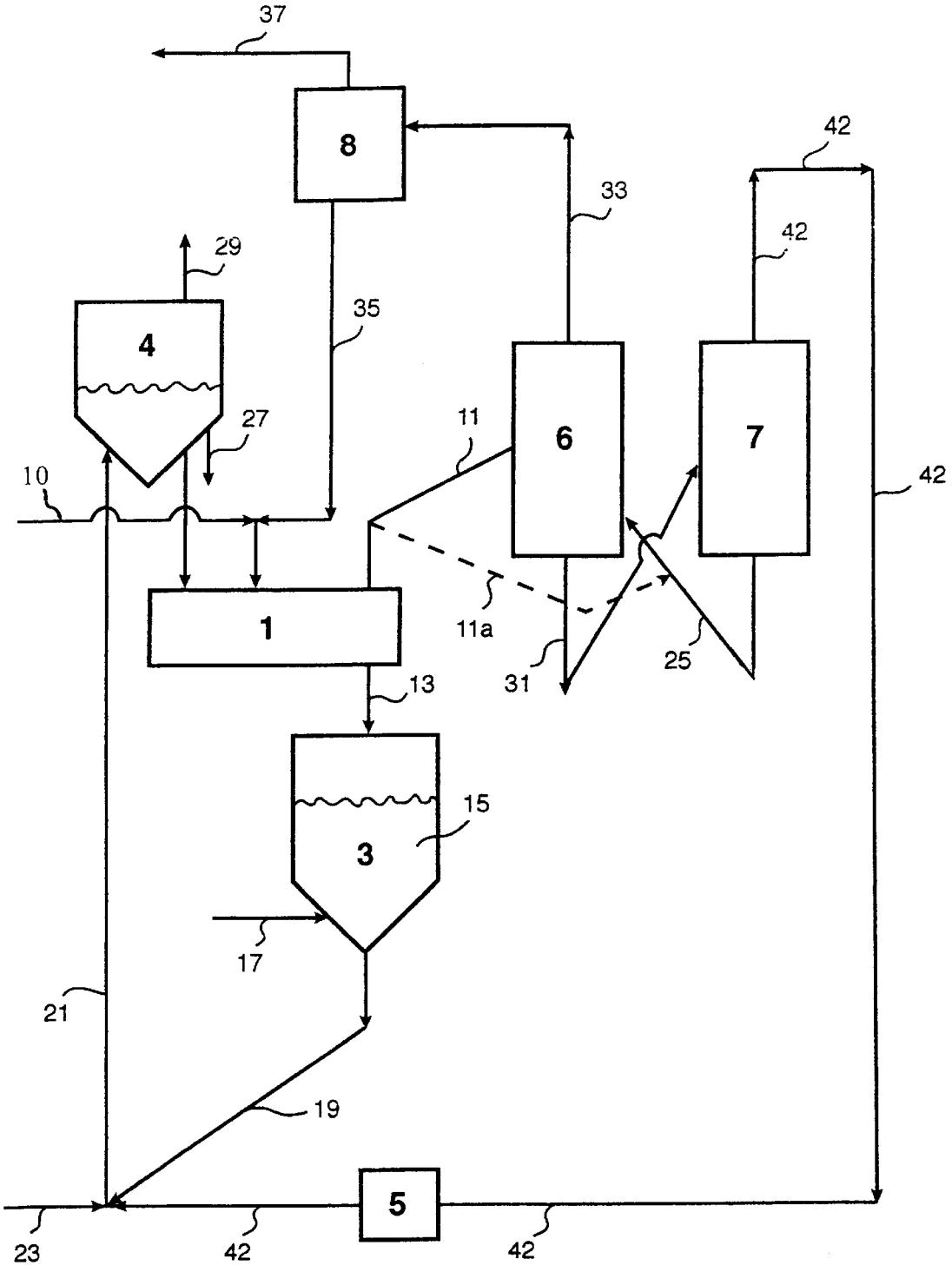
37
8
42
33
42
29
35
4
27
11
6
7
10
42
1
11a
31
25
13
15
3
17
21
19
5
23
42
42

TWO-STAGE PROCESS FOR CONVERTING RESIDUA TO GASOLINE BLENDSTOCKS AND LIGHT OLEFINS

CROSS-REFERENCE TO RELATED APPLICATION

This application is a continuation of U.S. patent application Ser. No. 09/418,061, filed Oct. 14, 1999, now abandoned.

BACKGROUND OF THE DISCLOSURE

1. Field of the Invention

The present invention relates to a two-stage process for converting petroleum residua and other low value oils to high valued gasoline blendstocks and light olefins. The first stage is comprised of a thermal process unit containing a reaction zone comprised of a horizontal moving bed of fluidized hot particles operated at temperatures from about 500 to 600° C. and having a short vapor residence time, and the second stage is comprised of a catalytic conversion zone operated at a temperature of about 525° C. to about 650° C., and also having a short vapor residence time, preferably shorter than that of the first stage reaction zone.

2. Background of the Invention

In a typical refinery, crude oils are subjected to atmospheric distillation to produce lighter fractions such as gas oils, kerosenes, gasolines, straight run naphtha, etc. Petroleum fractions in the gasoline boiling range, such as naphthas, and those fractions which can readily be thermally or catalytically converted to gasoline boiling range products, such as gas oils, are the most valuable product streams in the refinery. The residue from atmospheric distillation is distilled at pressures below atmospheric pressure to produce a vacuum gas oil distillate and a vacuum reduced residual oil which often contains relatively high levels of asphaltene molecules. These asphaltene molecules typically contain most of the Conradson Carbon residue and metal components of the residua. It also contains relatively high levels of heteroatoms, such as sulfur and nitrogen. Such feeds have little commercial value, primarily because they cannot be used as a fuel oil owing to ever stricter environmental regulations. They also have little value as feedstocks for refinery processes, such as fluid catalytic cracking, because they produce excessive amounts of gas and coke. Their high metals content also leads to catalyst deactivation. Thus, there is a need in petroleum refining for better ways to utilize residual feedstocks or to upgrade them to more valuable, cleaner, and lighter feeds.

Unlike residual feedstocks, more valuable feedstocks like gas oils are used in fluid catalytic cracking to produce transportation fuels as well as being used in steam crackers to make olefinic chemical products. A steam cracker is a thermal process unit comprised of fired coils where the feedstock is cracked at temperatures of about 540 to 800° C. in the presence of steam. While gas oils are adequate feedstocks for such purposes, they are also relatively expensive feedstocks because they are a preferred feedstock for producing transportation fuels. It would be desirable, from an economic point of view, to use lower valued feeds, such as residual feeds, in a steam cracker, but they are generally not suitable for such use because they are susceptible to excessive cracking, coke formation, and coke deposition in the cracking coils which leads to overheating and equipment plugging. In addition, it has been found that steam can react with coke at process temperatures to form substantial amounts of CO which dilutes product vapors and seriously complicates product recovery.

An attempt to overcome these problems was made in U.S. Pat. No. 2,768,127 which teaches the use of residual feedstocks for the production of aromatic and olefinic product streams. This is accomplished by contacting the residua feedstock in a fluidized bed of coke particles maintained at a temperature from about 675° to 760° C. While such a process is useful, there remains a need for improved processes for obtaining olefinic products from residual feedstocks without excessive cracking of product vapors.

U.S. Pat. No. 5,714,663, which is incorporated herein by reference, teaches a single stage process for obtaining a substantial amount of olefinic products from a residua feedstock by use of a short vapor contact time thermal process unit comprised of a horizontal moving bed of fluidized hot particles. While such a process is an improvement over the art, there is still a need for further improvements converting residua type feedstocks to more valuable lower boiling products, particularly gasoline and olefins.

SUMMARY OF THE INVENTION

In accordance with the present invention, there is provided a process for converting petroleum feedstocks boiling in the residua range to lower boiling products, which process comprises converting the feedstock in two stages, wherein:

(I) the first stage is comprised of:

- (i) a first stage heating zone wherein solids containing carbonaceous deposits are received from a stripping zone and heated in the presence of an oxidizing gas;
- (ii) a first stage reaction zone containing a horizontal moving bed of fluidized hot solids, which reaction zone is operated at a temperature from about 500° C. to about 600° C. and under conditions such that the solids residence time and the vapor residence time are independently controlled, which vapor residence time is less than about 2 seconds, and which solids residence is from about 5 to about 60 seconds; and
- (iii) a stripping zone through which solids having carbonaceous deposits thereon are received from the reaction zone and wherein lower boiling hydrocarbons and volatiles are recovered with a stripping gas; and (II) the second stage is comprised of:

- (i) a second stage heating zone wherein solids containing carbonaceous deposits are received from the second stage reaction zone;
- (ii) a second stage reaction zone which is operated in the presence of a catalyst for converting the feedstock to lower boiling products, and at a temperature from about 525° C. to about 650° C. and at vapor residence times of less than about 5 seconds;

which process comprises:

- (a) passing said residual feedstock to said first stage reaction zone where it is contacted with fluidized hot solids thereby resulting in a vaporized fraction and a solids fraction having high Conradson Carbon components and metal-containing components being deposited thereon;
- (b) separating the vaporized fraction from the solids fraction;
- (c) passing the solids fraction to a stripping zone wherein low boiling hydrocarbons and volatile material are stripped therefrom by contacting them with a stripping gas;
- (d) passing the stripped solids to said first stage heating zone where they are heated in an oxidizing environment to an effective temperature that will result in the production of flue gases and maintain the operating temperature of said first stage reaction zone when the solids are passed to the said reaction zone;

(e) separating the flue gas product from the solids of said first stage heating zone;

(f) recycling hot solids from said first stage heating zone to said first stage reaction zone where they are contacted with fresh feedstock;

(g) passing the vaporized reaction product of said first stage reaction zone to said second stage reaction zone where they are contacted with a catalyst at a temperature from about 525° C. to about 650° C. and at vapor residence times of less than about 5 seconds;

(h) separating a vapor fraction from a solids fraction of said second stage reaction zone;

(i) passing said solids fraction to a second stage heating zone where they are heated to an effective temperature that will combust carbonaceous deposits thereon and that will maintain the operating temperature of said second stage reaction zone when said solids are passed to said second stage reaction zone;

(j) recycling hot solids from said second stage heating zone to said second stage reaction zone where they are contacted with the vapor product from said first stage reaction zone; and (k) recovering the vapor phase reaction product from said second stage reaction zone.

In a preferred embodiment of the present invention, the vapor product from the second stage reaction zone is quenched to a temperature below which cracking will occur and products are recovered which include gasoline boiling range products, ethylene, and propylene.

BRIEF DESCRIPTION OF THE FIGURE

The sole FIGURE hereof is a schematic flow plan of a non-limiting preferred embodiment of the present invention.

DETAILED DESCRIPTION OF THE INVENTION

Residual feedstocks which are suitable for use in the present invention are those petroleum fractions boiling above about 480° C., preferably above about 540° C., more preferably above about 560° C. Non-limiting examples of such fractions include vacuum resids, atmospheric resids, heavy and reduced petroleum crude oil, pitch, asphalt, bitumen, tar sand oil, shale oil, sludge, slop oils, heavy hydrocarbonaceous waste, and lube extracts. It is understood that such residual feedstocks may also contain minor amounts of lower boiling material. These feedstocks typically cannot be used as feeds to steam crackers to produce olefinic products because they excessively coke. Such feeds will typically have a content of at least 5 wt. %, generally from about 5 to 50 wt. %. As to residue, see ASTM Test D189-165.

The instant process is practiced in such a way that the primary products are a gasoline boiling range stream and an olefin stream comprised mainly of ethylene and propylene, preferably propylene. Those streams boiling in the gasoline range include the hydrocarbon oils, or naphthas, boiling from about 20° C. to about 260° C., preferably from about 80° C. to about 200° C. The lower boiling products are produced from the residual feedstocks in accordance with the present invention in a two stage process. The first stage contains a horizontal fluidized bed reaction zone wherein the solids and vapor residence times are independently controlled and the second stage contains a reaction zone operated at a temperature at least about 25° C. higher than the first stage and wherein the vapor residence time is also short, preferably shorter than that of the first reaction stage. Reference is now made to the sole FIGURE hereof wherein a residual feedstock is fed via line 10 to a reaction zone 1 which contains a horizontal moving bed of fluidized hot solids and which is operated at a temperature from about 500° C. to about 600° C. The solids in the reaction zone will preferably be fluidized with assistance of a mechanical means. Typically, the particles will be fluidized by use of a fluidizing gas, such as steam, a mechanical means, and by the vapors which are produced in-situ by the vaporization of a fraction of the feedstock. It is preferred that the mechanical means be a mechanical mixing system characterized as having a relatively high mixing efficiency with only minor amounts of axial backmixing. Such a mixing system acts like a plug flow system with a flow pattern which ensures that the residence for substantially all particles in the reaction zone will be substantially the same. The most preferred mechanical mixer is the mixer referred to by Lurgi AG of Germany as the LR-Mixer or LR-Flash Coker which was originally designed for processing oil shale, coal, and tar sands. The LR-Mixer consists of two horizontally oriented rotating screws which aid in fluidizing the particles. Although it is preferred that the solid particles be coke particles, they may also be any other suitable refractory particulate material. Non-limiting examples of such other suitable refractory materials include those selected from the group consisting of silica, alumina, zirconia, magnesia, mullite, synthetically prepared or naturally occurring material such as pumice, clay, kieselguhr, diatomaceous earth, bauxite, and the like. It is within the scope of the present invention that the solids be inert or that they have catalytic properties. The solids will have an average particle size of about 40 microns to 2,000 microns, preferably from about 200 microns to about 1200 microns.

The feedstock is contacted with the fluidized hot solids at a temperature high enough to cause a substantial portion of the high Conradson Carbon and metal-containing components to deposit on the hot solid particles in the form of high molecular weight carbon and metal moieties, but not so high as to cause the formation of substantial amounts of olefinic products. This will preferably be at a temperature from about 500° C. to about 600° C., more preferably from about 530° C. to 570° C. The remaining portion of the feedstock will be vaporized on contact with the hot solids. The residence time of vapor products in reaction zone 1 will be an effective amount of time so that substantial secondary cracking is minimized. This amount of time will typically be less than about 2 seconds. The residence time of solids in the reaction zone will be from about 5 to 60 seconds, preferably from about 10 to 30 seconds. One novel aspect of this first stage reaction zone is that the residence times of the solids and the vapor phase can be independently controlled. Most fluidized and fixed bed processes are designed so that the solids residence time, and the vapor residence time cannot be independently controlled, especially at relatively short vapor residence times. It is also preferred that the short vapor contact time process unit be operated so that the ratio of solids to feed be from about 30 to 1, preferably 20 to 1, more preferably about 10 to 1, and most preferably from about 5 to 1. It is to be understood that the precise ratio of solids to feed will primarily depend on the heat balance requirement of the short vapor contact time reaction zone. Associating the solids to feed ratio with heat balance requirements is within the skill of those in the art, and thus will not be elaborated herein any further. A portion of the feedstock will deposit on the solids in the form of combustible carbonaceous material. Metal components will also deposit on the solids. Consequently, the vaporized portion will be substantially lower in both Conradson Carbon and metals when compared to the original feed.

Solids, having carbonaceous material deposited thereon, are passed from the first stage reaction zone 1 via line 13 to the bed of solids 15 in stripper 3. The solids pass downwardly through the stripper and past a stripping zone at the bottom section where lower boiling hydrocarbons and any remaining volatiles, or vaporizable material, are stripped from the solids by use of a stripping gas, preferably steam, introduced into the stripping zone via line 17. The stripped solids are passed via line 19 to line 21 where they are heated and transferred to collecting drum 4 with a lift medium, such as steam via line 23 flue gas via line 42 or from combustion fuel gas from auxiliary burner 5. The first stage heating zone will typically be operated at a pressure ranging from about 0 to 150 psig, preferably at a pressure ranging from about 15 to about 45 psig. While some carbonaceous residue will be burned from the solids in the heating zone, it is preferred that only partial combustion take place so that the solids, after passing through the heater, will have value as a fuel. Excess solids can be removed from the process unit via line 27. Flue gas is removed overhead from collecting drum 4 via line 29. The flue gas can be passed through a cyclone system (not shown) to remove most solid fines. Dedusted flue gas will be further cooled in a waste heat recovery system (not shown), scrubbed to remove contaminants and particulates, and passed to a CO boiler (not shown) to generate steam.

The vaporized fraction from the first stage reaction zone is passed via line 11 to the second stage reaction zone reactor 6. The operating temperature of this second stage catalytic conversion reaction zone is from about 525° C. to about 650° C., preferably from about 550° C to about 620° C. This second reaction stage, which is operated at more severe conditions than the first reaction zone will catalytically crack the hydrocarbons of the vapor product stream from the first reaction zone to lower boiling higher valued products, preferably gasoline boiling range blending stocks and olefins, primarily propylene. The vapor residence time of this second reaction zone will be less than about 5 seconds, preferably less than about 2 seconds. Non-limiting examples of reactor designs which can comprise this second stage include a fluid catalytic cracking (FCC) process units wherein the reaction takes place in the riser, although downflow transfer line and fluidized bed reactor systems could also be used.

Catalytic cracking is an established and widely used process in the petroleum refining industry for converting petroleum oils of relatively high boiling point to more valuable lower boiling products, including gasoline and middle distillates, such as kerosene, jet fuel and heating oil. The pre-eminent catalytic cracking process now in use is the fluid catalytic cracking process (FCC) in which a pre-heated feed is brought into contact with a hot cracking catalyst which is in the form of a fine powder, typically having a particle size of about 10–300 microns, usually about 100 microns, for the desired cracking reactions to take place. During the cracking, coke and hydrocarbonaceous material are deposited on the catalyst particles. This results in a loss of catalyst activity and selectivity. The coked catalyst particles, and associated hydrocarbon material, are subjected to a stripping process, usually with steam, to remove as much of the hydrocarbon material as technically and economically feasible. The stripped particles containing non-strippable coke, are removed from the stripper and sent to a regenerator where the coked catalyst particles are regenerated by being contacted with air, or a mixture of air and oxygen, at an elevated temperature. This results in the combustion of the coke which is a strongly exothermic reaction which, besides removing the coke, serves to heat the catalyst to the temperatures appropriate for the endothermic cracking reaction. The process is carried out in an integrated unit comprising the cracking reactor, the stripper, the regenerator, and the appropriate ancillary equipment. The catalyst is continuously circulated from the reactor or reaction zone, to the stripper and then to the regenerator and back to the reactor. The circulation rate is typically adjusted relative to the feed rate of the oil to maintain a heat balanced operation in which the heat produced in the regenerator is sufficient for maintaining the cracking reaction with the circulating regenerated catalyst being used as the heat transfer medium. Typical fluid catalytic cracking processes are described in the monograph Fluid Catalytic Cracking with Zeolite Catalysts, Venuto, P.B. and Habib, E. T., Marcel Dekker Inc. N.Y. 1979, which is incorporated herein by reference. As described in this monograph, catalysts which are conventionally used are based on zeolites, especially the large pore synthetic faujasites, zeolites X and Y.

Catalysts suitable for use in the practice of the present invention are those which are comprised of a crystalline zeolite having an average pore diameter less than about 0.7 nanometers (nm), said crystalline zeolite comprising from about 10 wt. % to about 50 wt. % of the total fluidized catalyst composition. It is preferred that the crystalline zeolite be selected from the family of medium pore size (<0.7 nm) crystalline aluminosilicates, otherwise referred to as zeolites. Of particular interest are the medium pore zeolites with a silica to alumina molar ratio of less than about 75:1, preferably less than about 50: 1, and more preferably less than about 40:1. The pore diameter also sometimes referred to as effective pore diameter can be measured using standard adsorption techniques and hydrocarbonaceous compounds of known minimum kinetic diameters. See Breck, Zeolite Molecular Sieves, 1974 and Anderson et al., J. Catalysis 58, 114 (1979), both of which are incorporated herein by reference.

Non-limiting examples of medium pore size zeolites that can be used in the practice of the present invention include zeolites such as members of the ZSM series, e.g., ZSM-5, ZSM-11, ZSM-12, ZSM-21, ZSM-23, ZSM-35, ZSM-38, and ZSM-48. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable medium pore size zeolites include the silicoaluminophosphates (SAPO), such as SAPO-4 and SAPO-1 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates. The medium pore size zeolites can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat.

No. 4,229,424 which is incorporated herein by reference. The crystalline admixtures are themselves medium pore size zeolites and are not to be confused with physical admixtures of zeolites in which distinct crystals of crystallites of different zeolites are physically present in the same catalyst composite or hydrothermal reaction mixtures.

The catalysts of the present invention are held together with an inorganic oxide matrix component. The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix is not catalytically active and will be comprised of oxides of silicon and aluminum. It is also preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ε-alumina, κ-alumina, and ρ-alumina can be employed. Preferably, the alumina species is an aluminum trihydroxide such as gibbsite, bayerite, nordstrandite, or doyelite. The matrix material may also contain phosphorous or aluminum phosphorous.

The second stage reactor may also be a riser reactor wherein both solids and vapor flow upwards. While the second stage reaction vessel can be any design which will allow short vapor contact time, it is more preferred that it be a cocurrent design as discussed above. The vapor contact time of this reaction zone is preferably less than about 5 second, more preferably less than about 2 seconds. Hot solids are received from the heater, or regenerator, 7 via line 25 to second stage reactor 6. It is preferred that the vapor products from reaction zone 1 be introduced into reaction zone 6 by introducing them via line 11*a* into transfer line 25 which is bringing hot catalyst particles to reaction zone 6. Introducing the vapor products into the transfer line is preferred because transfer lines typically provide a shorter contact time, thereby preventing undesirable secondary reactions from occurring. Spent catalyst particles are passed via line 31 to heater 7 which is operated at temperature to burn off carbon deposits, thus regenerating the catalyst. The hot catalyst is then recycled back to reaction zone via transfer line 25, thus providing heat to reaction zone 6. Flue gas from heater 7 is recovered overhead and passed to auxiliary burner 5 via line 42 to provide heat for solids passing to collecting drum 4 via line 21.

Reaction products having significant gasoline boiling range fraction and a propylene fraction exit second stage reactor 6 via line 33 and are passed to scrubber 8 where they are quenched to temperatures preferably below about 450° C., more preferably below about 340° C. Heavy products, including any particulates, are removed via line 35 and may be recycled to first stage reaction zone 1. Light products from scrubber 6 are removed overhead via line 37. The light product stream contains a substantial amount of olefins. For example, it will typically be a 510° C. minus product stream and contain about 7 to 10 wt. 5 methane, 12 to 18 wt. 5 ethylene, and 7 to 12 wt. 5 propylene, and 6 to 9 wt. 5 unsaturated $C_4$'s, such as butenes and butadienes, based on the total weight of the feed.

This vaporized portion will contain a substantial amount of olefinic products, typically in the range of about 20 to 50 wt. 5, preferably from about 25 to 50 wt. 5, and more preferably from about 30 to 50 wt. 5, based on the total weight of the product stream. The olefin portion of the product stream obtained by the practice of the present invention will typically be comprised of about 5 to 15 wt. 5, preferably about 7 to 10 wt. 5 methane; about 10 to 20 wt. 5, preferably about 12 to 18 wt. 5 ethylene; and about 5 to 15 wt. 5, preferably 7 to 12 wt. 5 propylene, based on the feed.

What is claimed is:

1. A process for converting petroleum feedstocks boiling in the residua range to lower boiling products, which process comprises converting the feedstock in two stages, wherein:

(I) the first stage is comprised of:

(i) a first stage heating zone wherein solids are coke which contain carbonaceous deposits and are received from a stripping zone and heated in the presence of an oxidizing gas;

(ii) a first stage reaction zone containing a horizontal moving bed of fluidized hot solids, which reaction zone is operated at a temperature from about 500° C. to about 600° C. and under conditions such that the solids residence time and the vapor residence time are independently controlled, which vapor residence time is less than about 2 seconds, and which solids residence is from about 5 to about 60 seconds; and (iii) a stripping zone through which solids having carbonaceous deposits thereon are received from the reaction zone and wherein lower boiling hydrocarbons and volatiles are recovered with a stripping gas; and (II) the second stage is comprised of:

(i) a second stage heating zone wherein solids containing carbonaceous deposits are received from the second stage reaction zone;

(ii) a second stage reaction zone which is operated under FCC conversion conditions an FCC in the presence of catalyst for converting the feedstock to lower boiling products, and at a temperature from about 525° C. to about 650° C. and at vapor residence times of less than about 5 seconds;

which process comprises:

(a) passing said residual feedstock to said first stage reaction zone where it is contacted with fluidized hot solids thereby resulting in a vaporized fraction and a solids fraction having high Conradson Carbon components and metal-containing components being deposited thereon;

(b) separating the vaporized fraction from the solids fraction;

(c) passing the solids fraction to a stripping zone wherein low boiling hydrocarbons and volatile material are stripped therefrom by contacting them with a stripping gas;

(d) passing the stripped solids to said first stage heating zone where they are heated in an oxidizing environment to an effective temperature that will result in the production of flue gases and maintain the operating temperature of said first stage reaction zone when the solids are passed to the said reaction zone;

(e) separating the flue gas product from the solids of said first stage heating zone;

(f) recycling hot solids from said first stage heating zone to said first stage reaction zone where they are contacted with fresh feedstock;

(g) passing the vaporized reaction product of said first stage reaction zone to said second stage reaction zone where they are contacted with a catalyst at a temperature from about 525° C. to about 650° C. and at vapor residence times of less than about 5 seconds;

(h) separating a vapor fraction from a solids fraction of said second stage reaction zone;

(i) passing said solids fraction to a second stage heating zone where they are heated to an effective temperature that will combust carbonaceous deposits thereon and that will maintain the operating temperature of said second stage reaction zone when said solids are passed to said second stage reaction zone;

(j) recycling hot solids from said second stage heating zone to said second stage reaction zone where they are contacted with the vapor product from said first stage reaction zone; and (k) recovering the vapor phase reaction product containing primarily gasoline and light olefins from said second stage reaction zone.

2. The process of claim 1 wherein the feedstock has an average boiling point above about 480° C.

3. The process of claim 2 wherein the feedstock has a content of at least about 5 wt. 5 and is selected from the group consisting of vacuum resids, atmospheric resids, heavy and reduced petroleum crude oil, pitch, asphalt, bitumen, tar sand oil, sludge, slop oils, heavy hydrocarbonaceous waste, and lube extracts.

4. The process of claim 1 wherein the primary products are selected from the group consisting of gasoline boiling range streams and olefin-rich streams.

5. The process of claim 4 wherein the gasoline boiling range streams have a boiling range of about 80° C. to about 200° C.

6. The process of claim 1 wherein the average particle size of the hot solids in the first stage reaction zone is from about 40 to 2,000 microns.

7. The process of claim 1 wherein the residence time of the vapor products in the first stage reaction zone is less than about 2 seconds.

8. The process of claim 1 wherein the residence time of the solids in the first stage reaction zone is from about 10 to 30 seconds.

9. The process of claim 1 wherein the solids to feed is from about 30 to 1.

10. The process of claim 1 wherein the vapor product from the second stage reaction zone is quenched to a temperature below which cracking will occur.

* * * * *